US005207859A

United States Patent [19]

Jacobs

[11] Patent Number: 5,207,859

[45] Date of Patent: May 4, 1993

[54] DEVICE FOR INTERCONNECTING TWO WEBS OF MATERIAL

[75] Inventor: Thomas G. M. Jacobs, Cuijk, Netherlands

[73] Assignee: Stork Contiweb B.V., Boxmeer, Netherlands

[21] Appl. No.: 613,677

[22] PCT Filed: Jul. 18, 1989

[86] PCT No.: PCT/NL89/00058

§ 371 Date: Jan. 18, 1991

§ 102(e) Date: Jan. 18, 1991

[87] PCT Pub. No.: WO90/01012

PCT Pub. Date: Feb. 8, 1990

[30] Foreign Application Priority Data

Jul. 19, 1988 [NL] Netherlands ..... 8801829

[51] Int. Cl.[5] ..... B65H 19/02

[52] U.S. Cl. ..... 156/502; 156/507; 242/58.4

[58] Field of Search ..... 156/157, 159, 502, 504, 156/505, 507; 242/58.1, 58.2, 58.3, 58.4, 58.5

[56] References Cited

U.S. PATENT DOCUMENTS

| | | | |
|---|---|---|---|
| 3,278,131 | 10/1966 | Niepmann | 242/58.1 |
| 3,440,126 | 4/1969 | Bartholomay et al. | 242/58.4 |
| 3,886,031 | 5/1975 | Taitel | 156/504 |
| 4,331,301 | 5/1982 | Martinez | 242/58.1 |
| 4,374,576 | 2/1983 | Ryan | 156/504 |
| 4,455,190 | 6/1984 | Bianchetto et al. | 156/504 |
| 4,859,270 | 8/1989 | Martin et al. | 156/504 |

FOREIGN PATENT DOCUMENTS

| | | |
|---|---|---|
| 0167917 | 1/1986 | European Pat. Off. . |
| 0179243 | 4/1986 | European Pat. Off. . |
| 2361300 | 6/1975 | Fed. Rep. of Germany . |
| 2141108 | 12/1984 | United Kingdom . |
| 2170177 | 6/1986 | United Kingdom . |

*Primary Examiner*—Michael W. Ball
*Assistant Examiner*—Steven D. Maki
*Attorney, Agent, or Firm*—Michael N. Meller

[57] ABSTRACT

A device is provided for connecting the trailing end of a web of material to the leading end of the following web of material. The web of material undergoes a processing operation downstream from the device. The device includes a frame having guide rollers for determining the travel path for the web of material. Pressure elements are provided in the device which are movable towards and away from each other at right angles to the travel path of the web of material. In addition, cutting elements for cutting through the web of material are also provided. The device can be made wide for interconnecting wide webs of material but it is also compact in structure.

2 Claims, 4 Drawing Sheets

DEVICE FOR INTERCONNECTING TWO WEBS OF MATERIAL

The present invention relates to a device for connecting the rear end of a web of material, which downstream undergoes a treatment or processing operation, to the front end of a following web of material, comprising a frame with guide rollers which determine a throughput section for the web of material, two pressure elements which are fitted on either side of the throughput section, and which are movable towards each other and away from each other virtually at right angles to said throughput section, and also cutting elements for cutting through the one and/or the other web of material.

Such a device is generally known and is used in, for example, printing machines in which the offcoming end of a used roll of paper has to be adhered to the beginning of a new roll of paper. In these known devices two rollers cooperating with each other are used as the pressure elements. The disadvantage of this is that the pressure force of these rollers has to be transferred via the bearings of these rollers, so that the pressure forces to be applied are limited. Besides, as a result of the deflection of the rollers, these known devices can be made only with a limited width, and processing of wide webs of material with them is thus not possible.

The object of the invention is to produce a device which can be made sufficiently wide for interconnecting wide webs of material, said device also being compact in structure and easy to operate.

These objects are achieved according to the invention in that the pressure elements each comprise a bar which is fixed between two plates movably suspended in the frame, each bar having a pressure face extending virtually along its entire length in the direction of the throughput section, the bars are provided with a slit-type recess extending virtually at right angles to the pressure face in the lengthwise direction of the bar, said slits connecting to each other when the bars are lying against each other, and a wire-type cutting element is fitted between the two bars at the level of these slits which can be displaced from a central position into the one or the other recess for cutting through a web of material.

The use of bars instead of rollers has the advantage that the structure can be made more rigid, so that the device can be made correspondingly wider. In addition, the pressure forces can easily be applied to the bars. It is particularly advantageous here to use a wire-type cutting element, which always remains between the two webs of material when the splice is being made, and can subsequently cut through the old offcoming web of material near the splice regardless of the side of this web on which the cutting element is located. This design of the cutting element thus permits a very compact and uncomplicated structure of the device.

In a preferred embodiment of the invention the two side plates by means of which each bar is suspended in the frame are hingedly connected at one side to an arm rotatably fixed on the frame, and at the other side are movably guided in a guide of the frame, in such a way that the bars are displaceable to the outside of the frame by turning through about 90°. In this way the pressure faces of the pressure elements are easily accessible for the operating personnel, in order to prepare the two webs of material on the pressure face.

Other advantageous characteristics and features according to the invention emerge from Sub-claims 3–8.

The invention is explained in greater detail with reference to the drawings, in which:

FIG. 3 shows a more detailed cross-section of a pressure bar on an enlarged scale;

Figure 1:
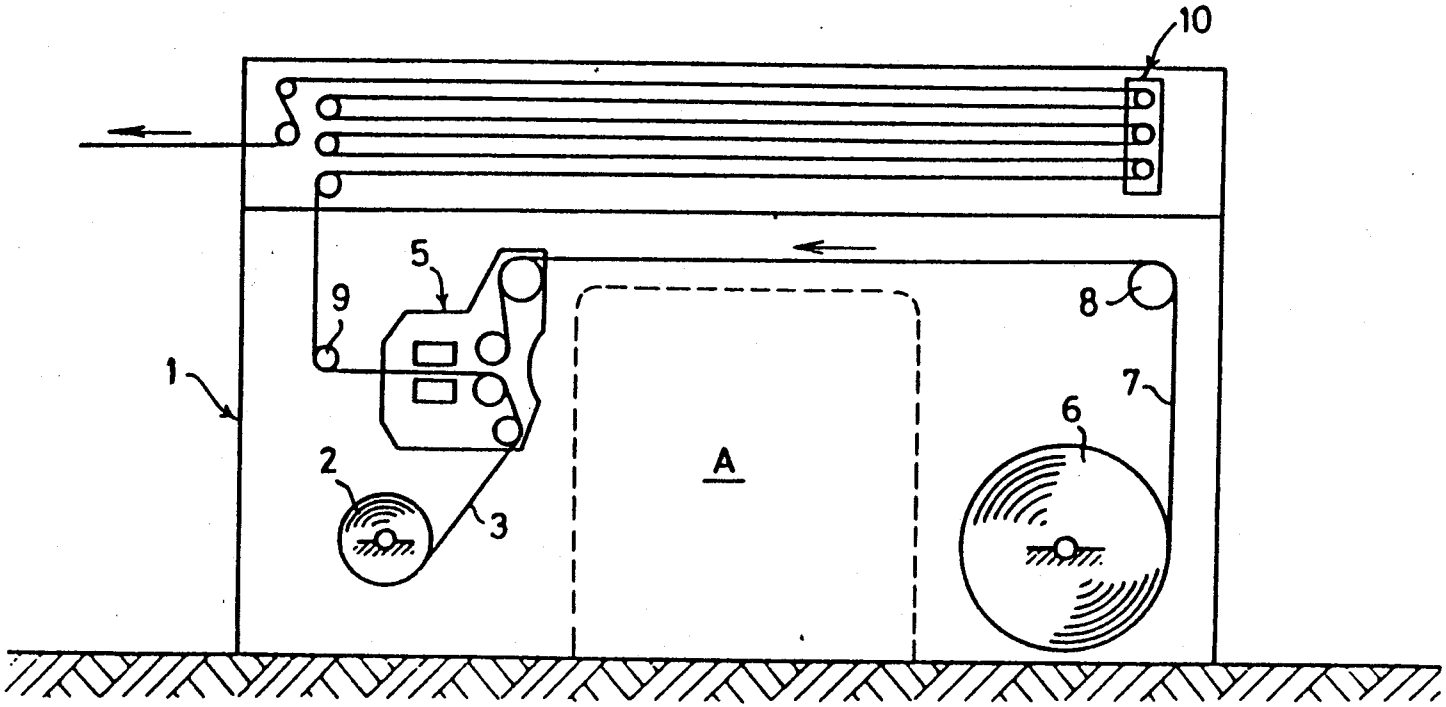
FIG. 1 is a schematic picture of a plant in which a device according to the invention is incorporated.

The plant shown in FIG. 1 comprises a housing 1, in which is disposed rotatably a first roller 2 from which a web of material 3 runs to a device 5. A second roller 6 is also supported rotatably in the housing, and the web 7 of material runs from it via a guide roller 8 also to the device 5. From the device 5 the web of material runs via a guide roller 9 to a schematically shown accumulator 10, and from here to, for example, a printing machine.

When, for example, the roll 2 of material is almost finished, the device 5 serves to connect the web 7 of material coming from the (new) roll 6 to the web 3 of material, and when this splice has been made to cut through the old web 3 of material, so that after this only material from roll 6 is fed to the printing machine (not shown). While the webs of material are being interconnected the roll 2 is stopped, while the printing machine can continue to work with the material stored in the accumulator 10. The layout of the plant 1 shown in the drawing has the advantage that a fairly large free space A is present between the two rollers, and this space can be used for the operating personnel, who thus have easy access to the device 5 for carrying out operating activities.

Figure 2:
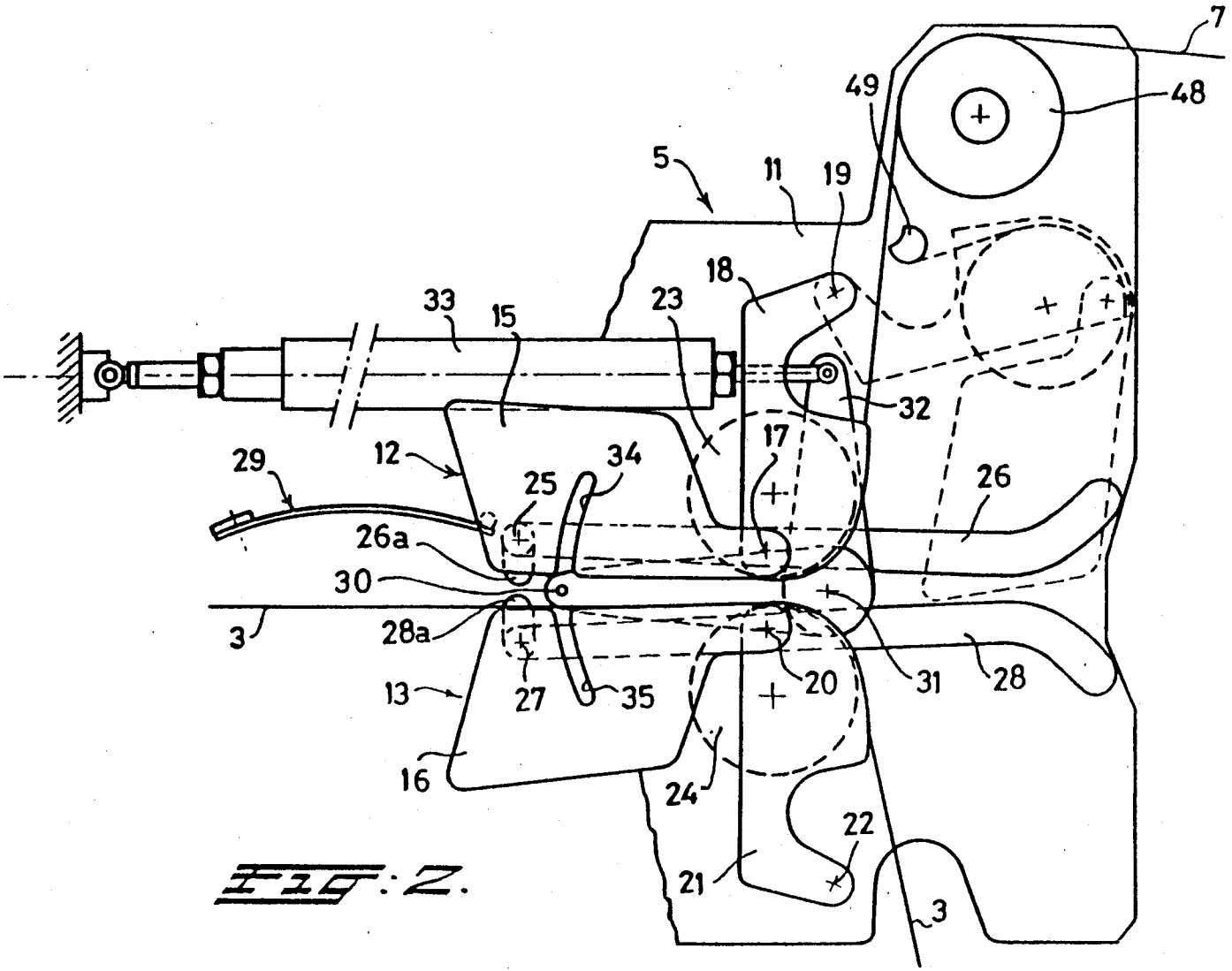
FIG. 2 shows schematically a partial view of the device according to the invention.
Figure 5:
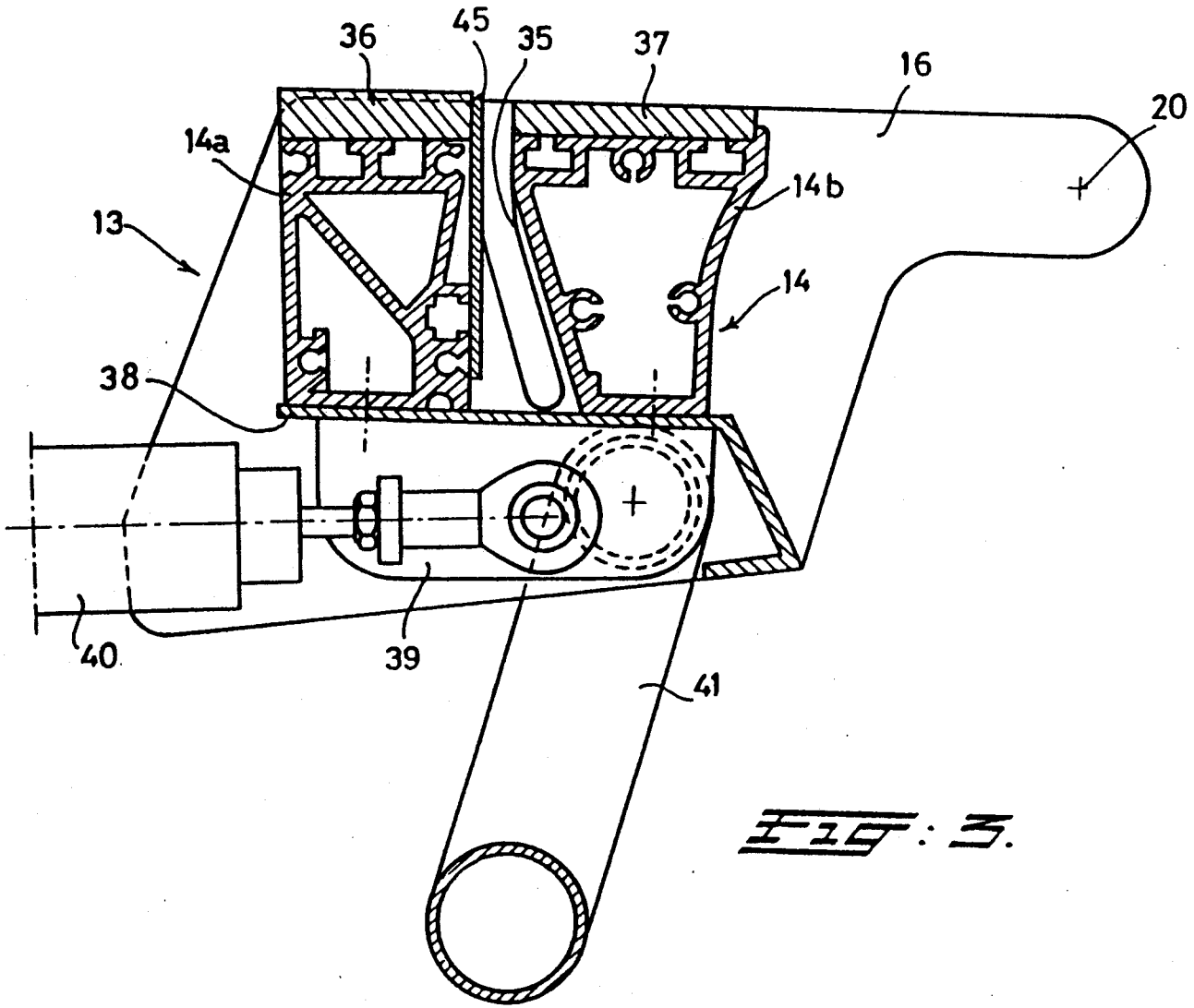
Figure 4:
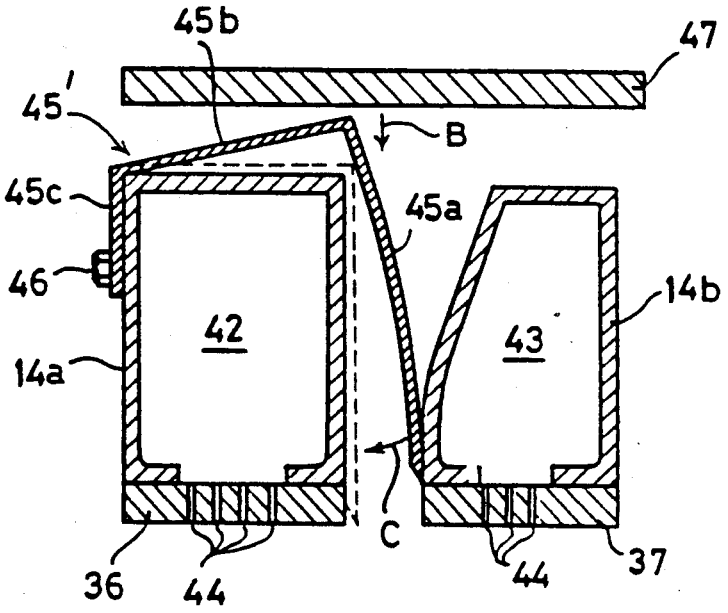
FIG. 4 shows schematically a cross-section of the pressure bar with retractable cutting plate.

The invention in fact lies in the design of the device 5, part of which is shown schematically in FIG. 2. This figure shows a frame 11, in which two pressure elements 12 and 13 are suspended opposite each other. Each pressure element in fact comprises two parallel side plates which are situated a distance away from each other, and which are each suspended movably in the frame, and between which a pressure bar 14, which will be described in greater detail later with reference to FIGS. 3 and 4, is fitted. FIG. 2 shows only one of the side plates 15, 16 of each pressure element. The plate 15 is hingedly connected at 17 to an arm 18, which is in turn hingedly connected at 19 to the frame 11. The plate 16 is also hingedly connected at 20 to an arm 21, which is in turn hingedly connected at 22 to the frame 11. The arm 18 carries a roller 23, while the arm 21 carries a roller 24.

The plate 15 has on the side facing away from the hinge point 17 a guide wheel 25 which is guided in a guide channel 26 which is disposed running virtually horizontally in the frame 11. In the same way the plate 16 is provided with a guide wheel 27, which is guided in a guide channel 28 of the frame 11. The two pressure elements 12 and 13 are disposed with their suspensions and guides symmetrical relative to an imaginary horizontal central plane between the two pressure elements.

The suspension of the respective plates 15 and 16 provides the possibility for the plate 15 therefore to be moved to the right from the position shown by solid lines in the drawing, in which case the arm 18 pivots anticlockwise about the point 19, and the plate 15 turns through about 90° until said plate and the arm 18 and the roller 23 take up the positions shown by dashed lines. It will be clear that the plate 16 and the arm 21 can be moved in a similar manner, in which case the arm 21 then rotates in a clockwise direction.

The guides 26, 28 running essentially horizontally are provided at the lefthand end in the drawing with a vertical-running part 26*a* and 28*a* respectively. These parts make it possible for the pressure elements 12 and 13 to be moved towards and away from each other again into the folded state shown by solid lines, as will be explained below. A spring element 29 presses the top pressure element 12 against the force of gravity into its raised rest position.

A wire-type cutting element 30, which is fixed to the end of a square lever 32 hingedly mounted at 31 on the frame, is disposed between the two pressure elements 12 and 13. The other free end of the square lever 32 is connected to a piston/cylinder assembly 33, which is hingedly connected at the other side to the frame. In the neutral position the cutting element 30 lies in the central plane between the two pressure elements 12 and 13, in which the hinge point 31 of the lever 32 is also situated. Through actuation of the cylinder 33 the square lever 32 can rotate about the hinge point 31, and the wire-type cutting element 30 can then move upwards as desired into a slit-type aperture 34 of the plate 15, or downwards into a slit-type aperture 35 of the plate 16. As will be seen later, during this movement the cutting element carries out a cutting action on the web of material lying above or below said cutting element.

FIG. 3 shows schematically a cross-section of the bottom pressure element 13, in which it must be imagined that the top pressure element 12 is designed identically, albeit symmetrically relative to the horizontal central plane between the two pressure elements. This figure shows the plate 16, with the pressure bar 14 in cross-section. As can be seen from this figure, the pressure bar 14 in fact comprises two parallel bars 14*a* and 14*b* which are situated a distance away from each other, and which are located on either side of the slit-type aperture 35 and leave a slit-type space between them. At the side facing the opposite pressure element 12 each bar 14*a*, 14*b* is provided with a pressure face 36, 37 which is made of a flexible rubber or plastic material. In fact only the rear face 36, viewed in the direction of movement of the web of material, serves as a pressure face for bringing about the join, while the face 37 serves to hold the web of material in the manner described below.

As already mentioned above, the bars 14*a* and 14*b* in fact extend between two plates 16 lying a distance away from each other, and in the central area between these two plates 16 provision is made for a cover plate 38 on the two bars 14*a* and 14*b*, on which a connecting piece 39 is fastened. A piston/cylinder assembly 40 is connected at one side to said connecting piece and at the other side to the frame 11. This piston/cylinder assembly 40 serves to move the pressure element 13 to the right out of the position shown by solid lines in FIG. 2, during which movement the pressure element 13 carries out a rotary movement through approximately 90°, so that the pressure faces 36 and 37 come to rest approximately vertically on the outside of the device (in other words, adjacent to space A in FIG. 1), and are accessible for the operating personnel.

A vacuum line 41 is also connected to the connecting piece 39, a connection being made through the connecting piece 39 between an internal compartment of the respective bars 14*a* and 14*b* and this vacuum line.

As schematically shown in FIG. 4, each bar 14*a* and 14*b* has an internal compartment 42, 43 which adjoins the relevant wall containing the pressure faces 36 and 37. A number of small apertures 44 which connect the relevant compartments 42 and 43 to the outside air are disposed in said walls.

A cutting plate 45 is disposed between the two bars 14*a* and 14*b* against one of the bars. This cutting plate cooperates with the wire-type cutting element 30, for cutting through a web of material. In FIG. 3 this cutting plate 45 is designed as a flat plate fixed against the bar 14*a*, the cutting edge of which reaches virtually to the pressure face 36. This arrangement can lead to injury of the operating personnel during operation of the device, and for this reason it is preferable to design the cutting plate 45 in such a way that the cutting plate automatically retracts inside the slit-type space between the bars 14*a* and 14*b* when the pressure element is not in operation. The principle of this automatic retraction is shown in FIG. 4. As can be seen from this figure, the cutting plate 45' is in the form of a U-shaped section, comprising a leg 45*a* which forms the actual cutting plate, a centre part 45*b* of the U, and a leg 45*c* which is considerably shorter than the opposite leg 45*a*. The cutting plate 45' is fastened by the leg 45*c* to the bar 14*a* by means of a bolt 46. The angle between the leg 45*c* and the centre part 45*b* is slightly greater than 90°, so that the cutting plate 45' normally assumes the position shown by solid lines, in which the centre part 45*b* and the leg 45*a* are away from the bar 14, and the free end of the leg 45*a* is retracted inside the space between the two bars 14*a* and 14*b*. If a pressure force is exerted on the two bars by means of a schematically shown pressure element 47, in which this pressure element moves down in the direction of the arrow B, this pressure element will press the centre part 45*b* of the cutting plate 45' against the bar 14*a*, as a result of which the leg 45*a* moves in the direction of the arrow C and also comes to rest against the bar 14*a*. The cutting plate then takes up the position shown by the dashed lines, in which the end of the leg 45*a* virtually coincides with the pressure face 36. This design has the advantage that when the pressure element is not in operation, i.e. when the two pressure elements are not pressed against each other, the cutting plate is always retracted inside the slit-type element, so that the risk of injury to operating personnel is prevented in an efficient manner.

The way in which the device works will be explained with reference to the situation shown in FIGS. 1 and 2, in which the web 3 of material coming off the roll 2 runs via the roller 24 of the device 5 to the accumulator 10 connected downstream thereof, and from there to the printing machine (not shown). When the roll 2 is beginning to come to an end, the pressure element 12 is moved to the right until it is in the position shown by dashed lines. The pressure faces 36 and 37 of this pressure element are now freely accessible for an operating person. The web 7 of material coming off the new roll 6 is then guided around the roller 48 and around the bar 49 in the device 5, and subsequently placed via the roller 23' on the pressure surface. In the process the web 7 is torn off in such a way that the free end of the web of material does not project beyond the pressure face 36. Through the application of a vacuum in the internal compartments 42 and 43 of the bars 14*a* and 14*b*, the web of material is sucked against the pressure face through the presence of the apertures 44. A double-sided adhesive strip is then applied by the operating personnel to the web of material lying against the pressure faces. The pressure element is then moved from the position shown by dotted lines again to the left, until said element is in the position shown by solid lines. The bar 49 here ensures that the length of the web of material remains the same in the two end positions of this element, and the web of material thus does not slip over the pressure face during this movement. If the splice now has to be made, the web 3 of material is stopped, and the pressure elements 12 and 13 are pressed with force against each other by suitable pressure elements, so that the two webs of material go against each other and adhere to each other by means of the adhesive strip. It will be clear that when they are pressed against each other the wire-type cutting element 30 is between the two webs of material. When the join is made the old web of material is cut through by means of the cutting element 30, to which end said cutting element in the example described is moved downwards by means of the lever 32 and the cylinder 33.

When the pressure forces exerted by means of the pressure elements have been released the pressure element 13 falls down again by the force of gravity, and the pressure element 12 is pressed upwards by the spring element 29. The cutting element 30 can now return to its neutral position and, by driving of the new roll 6, the web of material coming off this roll is guided via the device 5 to the accumulator 10 and the printing machine. The old roll 2 can be removed and is replaced by a new roll.

I claim:

1. Device for connecting the trailing end of a first web of material, which downstream of the device undergoes a treatment or processing operation, to the leading end of a second web of material, comprising:

a frame with guide rollers and two movable pressure elements each provided with a roller, said guide rollers in combination with a roller of one of said pressure elements determining a travel path for said first web of material, said pressure elements being arranged on opposite sides of said travel path;

each pressure element comprising a bar fixed between two side plates, each bar having a pressure face extending substantially along its entire length and a slit in said pressure face extending in lengthwise direction of the bar, each pressure element having a working position, wherein said pressure faces of said pressure elements are opposed and, face each other on opposite sides of said travel path, said slits communicate with each other, and said pressure elements are movable towards and away from each other at right angles to said travel path along the working position to connect said webs, each pressure element having a rest position which is upstream of the roller of said opposing pressure element in said working position and wherein said pressure element in said rest position exposes its pressure face in preparation of said leading edge of said second web substantially at right angles to its working position;

a wire cutting element arranged between said two pressure elements in said working position, which cutting element can be displaced from a central position into either of said slits for cutting through said trailing end of said first web of material, each pressure element being movable between said working position and said rest position by means of said side plates which are each suspended in said frame by means of an arm pivotally connected to said frame and to a hinge point of said side plate and which extends substantially at right angles away from said travel path when that pressure element is in said working position, and by means of a guide wheel fixed to said side plate downstream of said hinge point, said guide wheel being slidably guided in a corresponding guide slot of said frame, said guide slot having a first portion at right angles to said travel path to receive said guide wheel in said working position and a second portion extending substantially parallel to said travel path.

2. Device according to claim 1, wherein the slit of each bar contains a cutting plate having an operating position near said pressure face for cooperating with said wire cutting element and a retracted idle position away from said pressure face.

* * * * *